United States Patent [19]

Ozawa et al.

[11] Patent Number: 4,640,634

[45] Date of Patent: Feb. 3, 1987

[54] PRINTER WITH IMPROVED CARRIAGE AND CHARACTER WHEEL DRIVING MEANS

[75] Inventors: Toshiaki Ozawa, Tokyo; Yasuaki Yamada, Funabashi; Hiroatsu Kondo, Zushi, all of Japan

[73] Assignee: Canon Kabushiki Kaisha, Tokyo, Japan

[21] Appl. No.: 710,530

[22] Filed: Mar. 12, 1985

Related U.S. Application Data

[63] Continuation of Ser. No. 525,802, Aug. 24, 1983, abandoned, which is a continuation of Ser. No. 280,098, Jul. 2, 1981, abandoned, which is a continuation of Ser. No. 70,985, Aug. 30, 1979, abandoned.

[30] Foreign Application Priority Data

Sep. 5, 1978 [JP] Japan ..... 53-108054
Sep. 5, 1978 [JP] Japan ..... 53-108055

[51] Int. Cl.[4] ..... B41J 23/00; B41J 1/30
[52] U.S. Cl. ..... 400/144.2
[58] Field of Search ..... 400/144.2, 144.3, 185, 400/187, 320, 322, 328

[56] References Cited

U.S. PATENT DOCUMENTS 3,924,725 12/1975 Kuhn et al. ..... 400/144.3
4,058,195 11/1977 Fravel et al. ..... 400/62
4,128,346 12/1978 Ragland ..... 400/320 X
4,239,400 12/1980 Giolitti et al. ..... 400/144.2

FOREIGN PATENT DOCUMENTS 2158263 5/1972 Fed. Rep. of Germany ... 400/144.2
2160955 6/1972 Fed. Rep. of Germany ... 400/144.2

OTHER PUBLICATIONS

*IBM Tech. Disc. Bulletin,* by J. H. Meier, vol. 20, No. 1, Jun., 1977, pp. 100–101.
*IBM Tech. Disc. Bulletin,* by S. F. Kambic, vol. 20, No. 3, Aug., 1977, pp. 1103–1104.
"Character Impact Printer Offers Maximum Printing Flexibility" by R. B. Bump et al., Hewlett-Packard Journal, vol. 27, No. 10, p. 19–23, Jun. 1976.

*Primary Examiner*—Paul T. Sewell
*Attorney, Agent, or Firm*—Fitzpatrick, Cella, Harper & Scinto

[57] ABSTRACT

A printer in which selection of a character wheel is effected under servo-control of a motor has a carriage movable parallel to a platen, a character wheel rotatable by being supported on the carriage by means of a bearing, and a motor installed outside the carriage for rotating the character wheel.

11 Claims, 9 Drawing Figures

PRINTER WITH IMPROVED CARRIAGE AND CHARACTER WHEEL DRIVING MEANS

This application is a continuation of application Ser. No. 525,802 filed Aug. 24, 1983 now abandoned, which is a continuation of Ser. No. 280,098, filed July 2, 1981, now abandoned, which is a continuation of Ser. No. 70,985, filed Aug. 30, 1979, now abandoned.

BACKGROUND OF THE INVENTION

1. Field of the Invention

This invention relates to a printer.

2. Description of the Prior Art

Along with the recent advancement of the electronic art, mechanical parts of a printer have been replaced by a motor, a solenoid, etc., thereby enhancing the reliability of the instrument.

This electric printer has a great merit of enhanced reliability while, on the other hand, it is expensive because the motor and the electrical elements of the control system therefore are more expensive than the mechanical parts.

Further, in the electric printer, a motor for rotatively driving a character wheel is mounted on a carriage which is provided with a character wheel, a ribbon feeding motor, a ribbon shift solenoid, a printing hammer, etc. This leads to a greater mass of the carriage and also to a larger size of the spacing motor for reciprocally moving the carriage parallel to the axis of the platen.

Therefore, to improve the printing speed, an effort to reduce the inertia of the character wheel has heretofore been made, but this has a limitation and the character wheel driving motor must be larger in size. This has necessarily led to a problem that a large spacing motor must be used.

Also, in the conventional printer, the character wheel driving motor is mounted on the carriage and so, the mass of the carriage is great. Therefore, to improve the printing speed, the inertia of the the character wheel must be reduced and the mass of the entire carriage must be minimized by the use of a small character wheel motor having a small mass to thereby enhance the response speed of the carriage driving motor. Since, however, reducing the inertia of the character wheel encounters a limitation, a considerably large character wheel driving motor must be used to improve the printing speed and this has necessarily led to an inconvenience that the carriage driving motor must also be larger.

SUMMARY OF THE INVENTION

It is an object of the present invention to solve these problems and to install the character wheel driving motor ouside the carriage to thereby prevent the mass of the motor from becoming a load of the spacing motor.

It is another object of the present invention to use a single motor as the character wheel driving motor and the carriage driving motor (spacing motor) instead of multiple motors which have heretofore been used, thereby reducing the number of motors and their control systems and providing an inexpensive electrically operated printer.

It is still another object of the present invention to eliminate said inconvenience and improve the printing speed.

It is yet another object of the present invention to provide a printer in which selection of a character wheel is effected under servo-control of a motor, said printer having a carriage movable parallel to a platen, a character wheel rotatable by being supported on the cariage by means of a bearing, and a motor installed outside the carriage for rotating the character wheel.

It is a further object of the present invention to provide a printer in which selection of a character wheel is effected under servo-control of a motor, said printer having a carriage movable parallel to a platen, a character wheel rotatable by being supported on the carriage by means of a bearing, a motor installed outside the carriage for rotating the character wheel, a slit disc operable in association with the character wheel, a detector disposed in opposed relationship with the slit disc, and means for controlling the character wheel driving motor by a character wheel position signal generated by the detector.

It is a further object of the present invention to provide a printer having a carriage movable along a platen for feeding printing paper and parallel to the axis thereof, the carriage being provided thereon with a character wheel, a printing hammer and a pulley for imparting a rotational force to the character wheel, the printer being provided with a changeover mechanism for operatively associating the carriage and the character wheel with a drive motor so that, after the braking of the carriage, the rotational force of the drive motor is changed over for rotatively driving the character wheel and that, after the braking of the character wheel, the rotatonal force of the drive motor is changed over for reciprocally moving the carriage.

It is a further object of the present invention to provide such a printer wherein a member for exerting a brake on the rotation of the character wheel is mounted on the carriage.

It is a further object of the present invention to provide such a printer wherein a member for operating the member for exerting a brake on the rotation of the character wheel is provided outside the carriage.

The invention will become more fully apparent from the following detailed description of some embodiments thereof taken in conjunction with the accompanying drawings.

DESCRIPTION OF THE PREFERRED EMBODIMENTS

Figure 1:
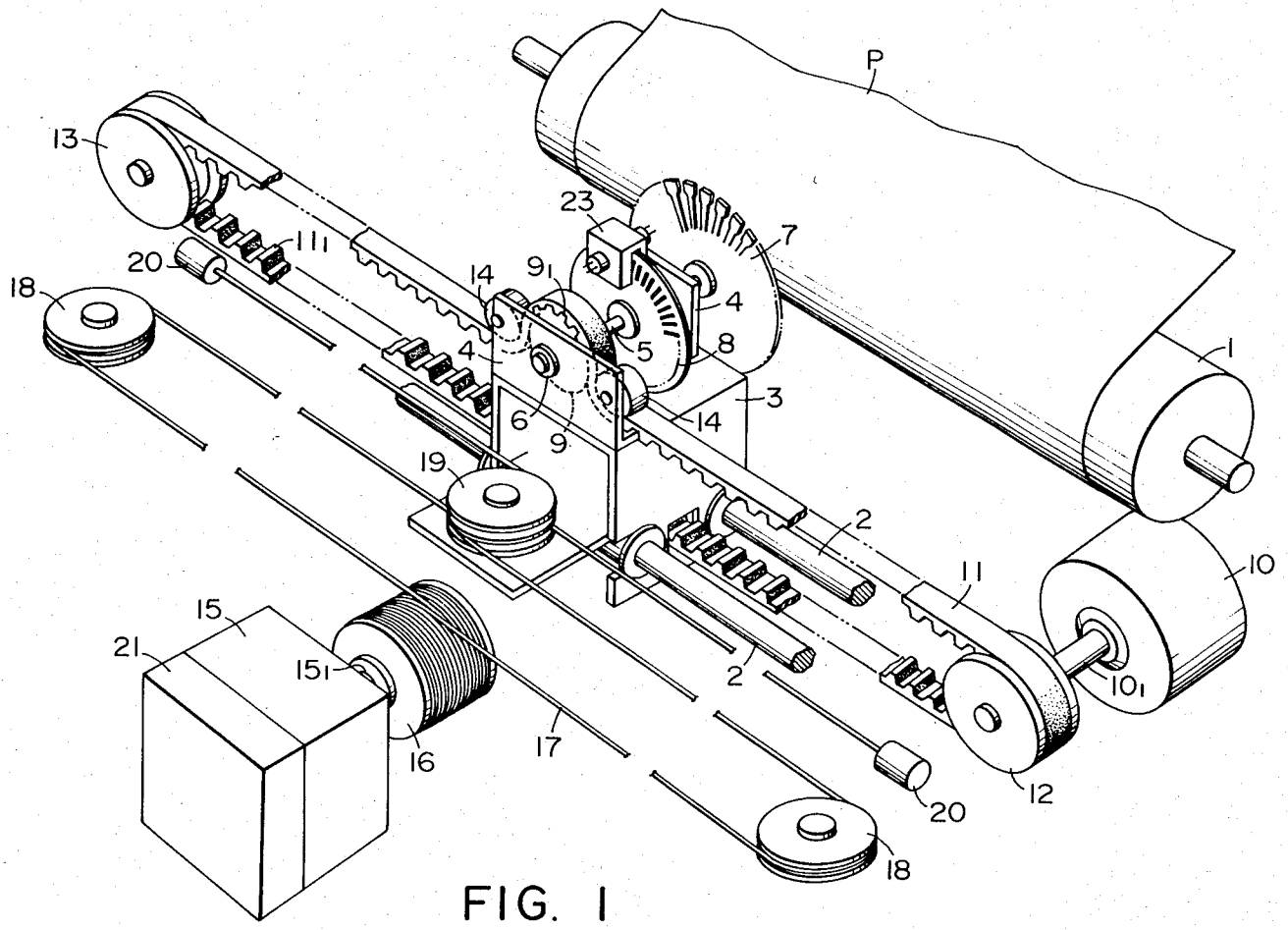
FIG. 1 is a perspective view showing the essential portions of the printer according to the present invention.

In FIG. 1, there are seen a platen 1 for feeding printing paper P guide rails 2, 2 extending parallel to the platen 1, a carriage 3 reciprocably supported on the guide rails 2, 2, bearing fittings 4, 4 provided on the upper surface of the carriage, and a shaft 5 rotatably supported on the bearing fittings 4, 4 by means of a bearing 6 and having mounted thereon a character wheel 7, a character position detecting slit disc 8 and a pulley 9. There are further seen a character wheel driving motor 10 fixed to a printer frame (not shown), and an endless belt 11 for transmitting the rotative drive of the motor 10 to the shaft 5, the endless belt being passed over the pulley 9 and extending over and between a pulley 12 mounted on a motor shaft $10_1$ and a pulley 13 mounted to the printer frame. The inner peripheral surface of the belt 11 is formed with teeth $11_1$ for engagement with the teeth $9_1$ of the pulley 9 to ensure positive transmission of the drive therebetween. Idlers 14 and 14 journalled to the bearing fittings 4 and 4 may urge the endless belt 11 against the pulley 9. There are further seen a drive or spacing motor 15 for the carriage 3, a take-up pulley 16 mounted on a motor shaft $15_1$, and a wire 17 wound on the pulley 16. The wire 17 is passed over guide pulleys 18, 18 journalled to the printer frame and a pulley 19 journalled to the carriage 3, and the opposite ends of the wire are secured to fixing shafts 20 and 20 provided on the left and right sides of the printer frame. Designated by 21 is a position detecting device for controlling the speed of the spacing motor 15 and for controlling the position of the carriage.

Figure 2:
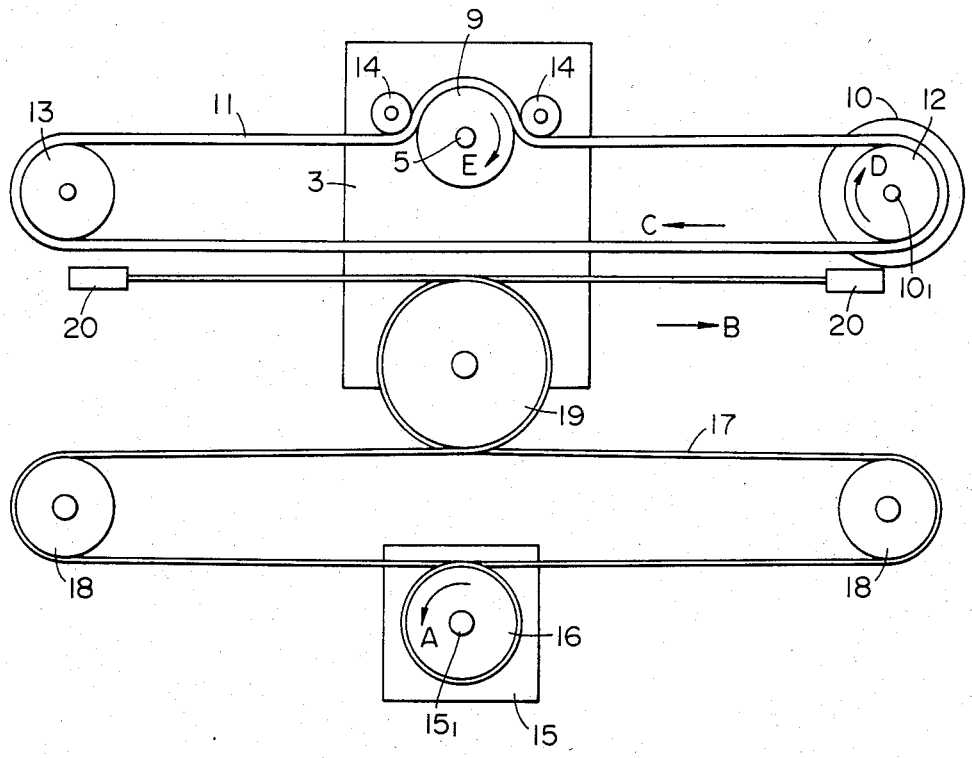
FIG. 2 is a front view of the drive transmission system for illustrating the operations of the various portions of the printer of FIG. 1.

Operation of the printer of the present invention will now be described with reference to FIG. 2. When the spacing motor 15 is stopped an the motor 10 is rotated in the direction of arrow D, the character wheel 7 is rotated in the direction of arrow E through the agency of the endless belt 11, pulley 9 and shaft 5. This amount of rotation is detected by the slit disc 8 and detector 23 and when a character to be printed has come to oppose the printing paper P, the motor 10 is stopped with zero voltage applied thereto as will hereinafter be described, thus stopping the character wheel 7. During the rotation of the character wheel 7, when the carriage 3 tries to move by receiving the rotative force thereof, the spacing motor 15 generates a force in the direction to prevent the movement of the carriage 3, which thus cannot move.

During the stopped condition of the motor 10, when the spacing motor 15 is rotated in the direction of arrow A, the carriage 3 is moved in the direction of arrow B by the tension of the wire 17. When this occurs, the endless belt 11 is urged against the pulley 9 by the idlers 14 and 14 and the drive motor 10 for the belt 11 is being stopped and therefore, the pulley 9, while being stopped, moves the belt 11 in the direction of arrow C with the movement of the carriage 3 to rotate the pulley 12 in the direction of arrow D. The amount of movement of this carriage 3 is detected by the position detecting device to stop the carriage at a predetermined printing position.

Figure 3:
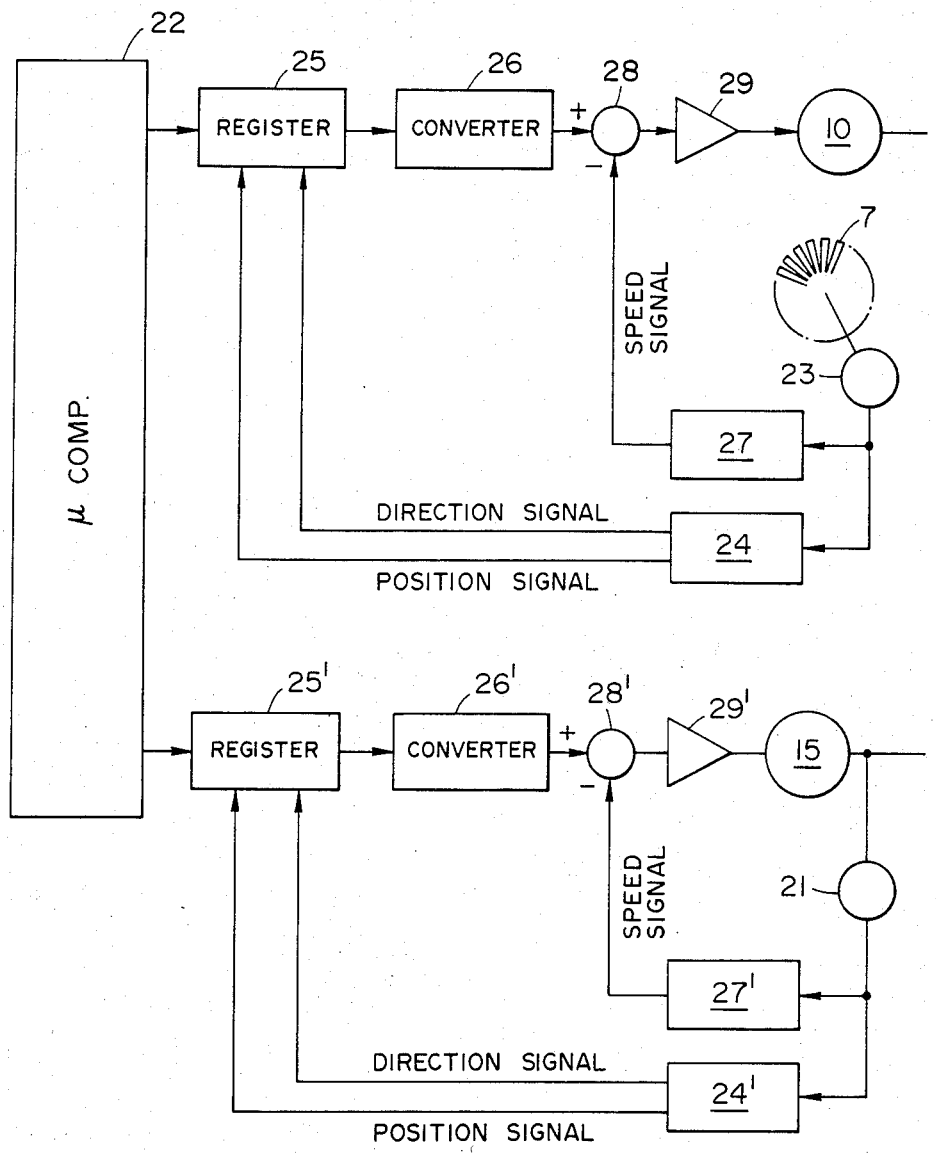
FIG. 3 is a block diagram of the electric control system.

In FIG. 3 which is a block diagram of the electric control system of the printer according to the present invention. reference character 22 designates a microcomputer for controlling the independent two servomotor systems of the carriage 3 and the character wheel 7.

The signal from a character wheel encoder comprising the slit disc 8 and a detector 23 disposed in opposed relationship therewith passes through a pulse shaping circuit 24 to provide a position signal pulse which corrects the content of a position error register 25. The output of this position error register 25 passes through a digital-analog converting circuit 26 to provide a position signal. Also, the signal from the character wheel encoder passes through a frequency-voltage converter 27 to provide a speed signal, and substraction is effected between this speed signal and the said position signal by a subtractor 28, the output of which is amplified by an amplifier 29 and applied to the motor 10. The voltage applied to the motor 10 approximates to zero as the character wheel 7 approaches its target position, and becomes zero when the character wheel 7 is stopped. Thus, the motor 10 is stopped and it becomes possible to move the belt 11 in the direction of arrow C with the movement of the carriage 3 and rotate the pulley 12 in the direction of arrow D.

The servomotor system of the carriage 3, like the servomotor system of the character wheel 7, comprises circuit elements 24'–29' and operates in the same manner as described above.

When the character wheel driving motor 10 and the spacing motor 15 are operated at the same time, the two motors 10 and 15 affect each other as a load in the case of servo control and it is therefore desirable that these two motors be operated independently of each other with an operating time difference therebetween. However, they may be operated at the same time although more or less variation occurs to their down time.

According to the present invention, as described above, the character wheel driving motor is not mounted on the carriage and therefore, the mass of the carriage is small to permit the use of a spacing motor which is small in size and capacity. Also, even if use is made of a character wheel driving motor having a great mass and a large size and a great capacity to enhance the rotational speed of the character wheel, it will impart no adverse influence to the spacing motor.

Figure 4:
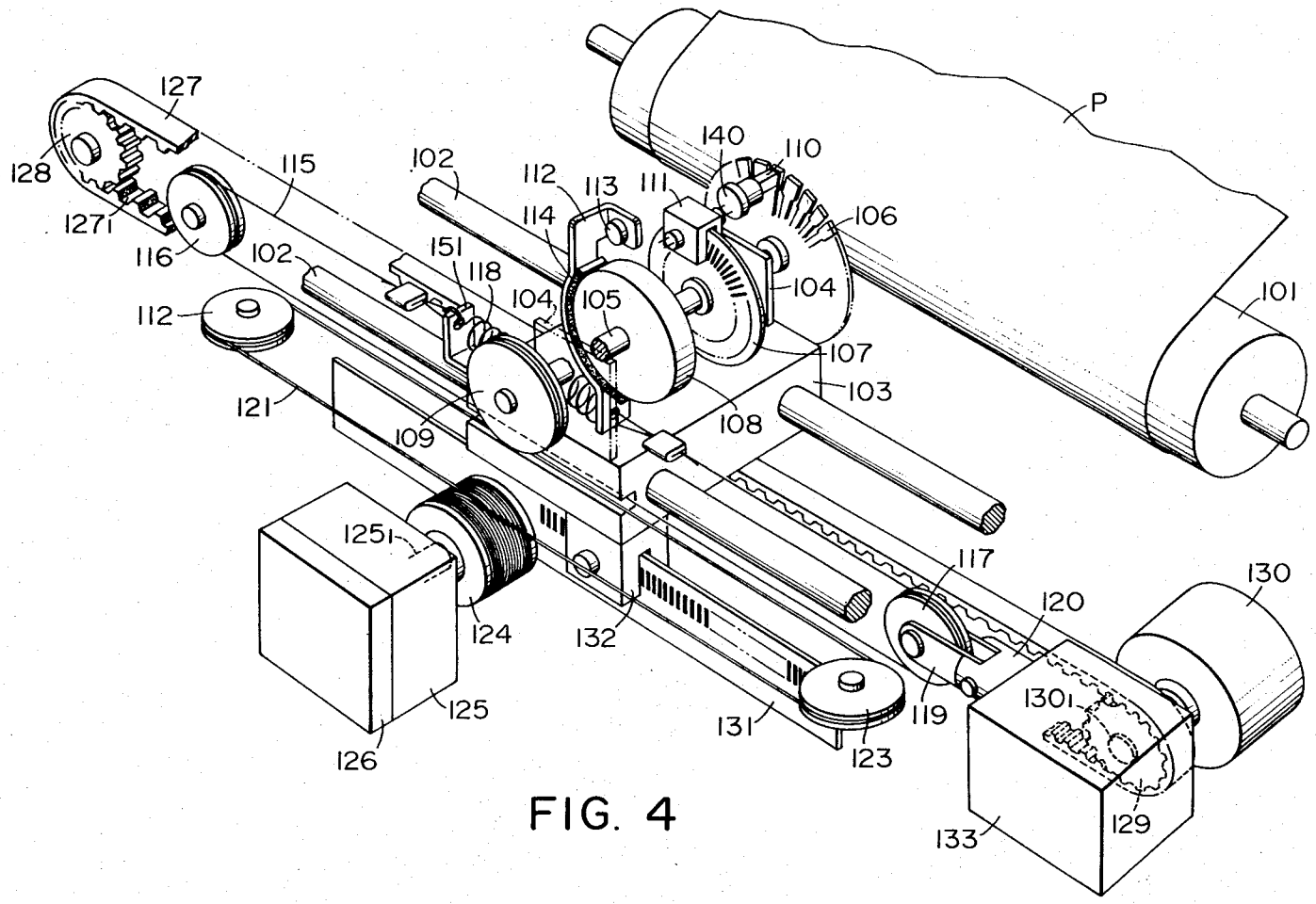
FIG. 4 is a perspective view showing the essential portions of the printer according to another embodiment of the present invention.

Another embodiment of the present invention will now be described. In FIG. 4 which is a perspective view showing essential portions of the printer according to the present invention, there are seen a platen 101 for feeding printing paper P, guide rails 102, 102 extending parallel to the platen 101, a carriage 103 reciprocably supported on the guide rails 102, 102, bearing fittings 104, 104 provided on the upper surface of the carriage, and a shaft 105 rotatably supported on the bearing fittings 104, 104 and having mounted thereon a character wheel 106, a character position detecting slit disc 107, a brake drum 108 and a pulley 109. There are further seen a printing hammer 110, a detector 111 disposed in opposed relationship with the slit disc 107, and a brake lever 112 pivotable with a support shaft 113 as the fulcrum. These members 111–113 are mounted on the carriage 103 through a support member, not shown. A brake piece 114 formed of a wear resisting material such as leather or asbestos having a great friction coefficient is attached to the inner surface of the brake lever 112, namely, that surface of the brake lever which is opposed to the brake drum.

A brake operating wire 115 is passed over pulleys 116 and 117 and has one end thereof secured to the brake lever 112 and the other end secured to an angle 151 provided on the upper surface of the carriage. On end of a spring 118 for biasing the brake lever 112 in a direction to release the brake lever from the brake drum 108 is attached to the angle 151, and the other end of the spring 118 is attached to the free end of the brake lever 112. A pulley 116 is mounted to a printer frame (not shown) and a pulley 117 is mounted on a plunger 120 through a lever 119.

A wire 121 is wound and a pulley 109 a plurality of times to prevent the slippage thereof and the opposite ends of the wire 121 pass over pulleys 122 and 123 journalled to the printer frame and are wound on a take-up pulley 124. This wire may be replaced by an endless belt. The take-up pulley 124 is secured to the rotary shaft $125_1$ of a drive motor 125. Designated by 126 is a tachogenerator for detecting the rotational speed of the drive motor 125, and denoted by 127 is an endless timing belt passed over gears 128 and 129 with the teeth $127_1$ of the endless belt engaged with these gears, and a part of the endless timing belt is secured to the carriage 103. The gear 128 is journalled to the printer frame, and the gear 129 is mounted on the shaft $130_1$ of an electromagnetic brake 130. Designated by 131 is a slit plate parallel to the guide rails 102, 102, and denoted by 132 is a detector provided on the carriage 103 in opposed relationship with the slit plate 131.

Figure 5:
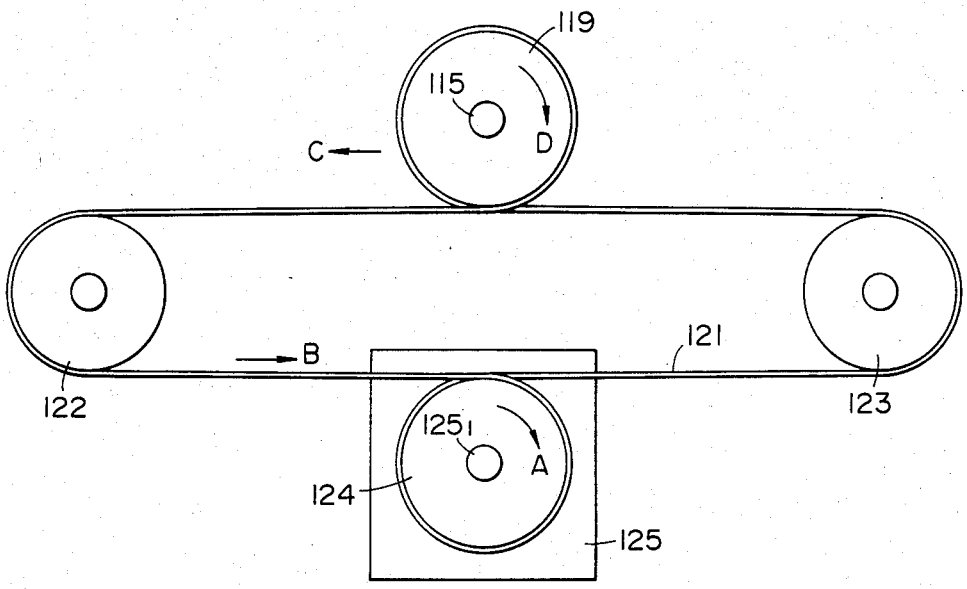
FIGS. 5 and 6 are front views of the drive transmission system for illustrating the operations of the various portions of the printer of FIG. 4.
Figure 6:
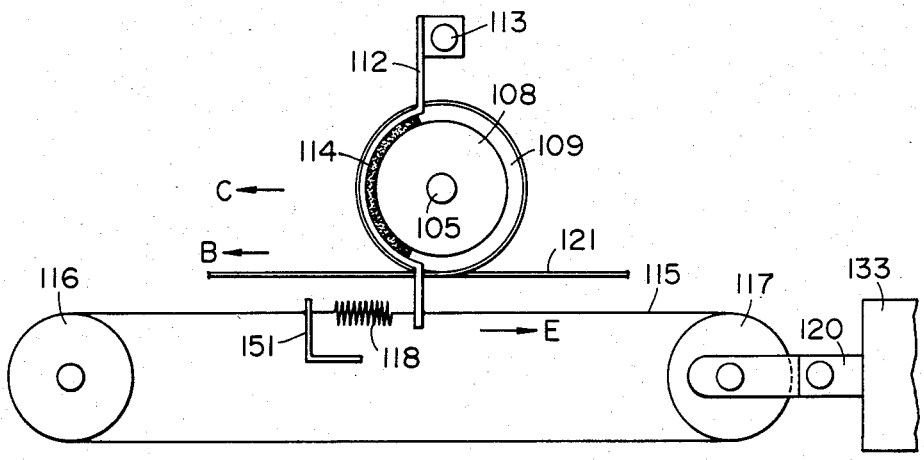

Reference is now had to FIGS. 5 and 6 to describe the operation of the printer according to the present invention. To rotate the character wheel 106, the electromagnetic brake 130 is operated to apply a brake to the carriage 103 against movement through the gear 129 and the belt 127. In this state, when the motor 125 is rotated in the direction of arrow A, the wire 121 is pulled in the direction of arrow B. Therefore, a moving force in the direction of arrow C acts on the carriage 103, but since the carriage 103 has already been braked, the tension of the wire 121 acts to rotate the pulley 109 in the direction of arrow D and rotate the character wheel 106 on the same shaft as the pulley 109. This amount of rotation is detected by the slit disc 107 and the detector 111 to bring the character wheel 106 to a halt when a predetermined character has come to oppose the printing paper P.

To move the carriage 103, a solenoid 133 is electrically energize to attract the plunger 120. By this attraction, a tention in the direction of arrow E is imparted to the wire 115 through the pulley 117 to pull the brake lever 112 against the force of the spring 118. Thus, the brake piece 114 is urged against the brake drum 108 to brake the shaft 105 and thus, the character wheel 106. In this state, when the motor 125 is rotated in the direction of arrow A, the carriage 103 is moved in the direction of arrow C by a tension in the direction of arrow B created in the wire 121. This amount of movement is detected by the slit plate 131 and the detector 132 to bring the carriage 103 to a halt at a printing position.

Figure 7:
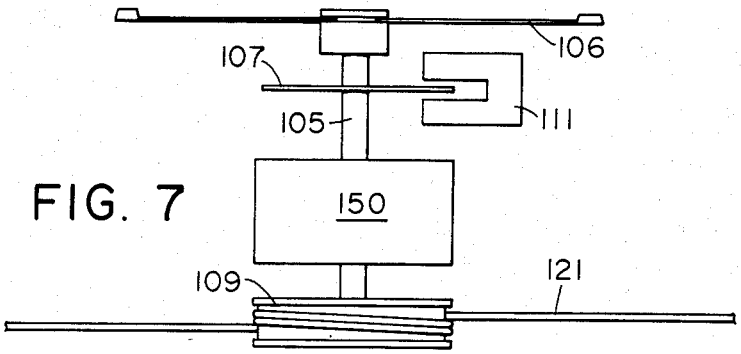
FIG. 7 is a plan view of a modification of the control mechanism for the character wheel.

In the above-described embodiment, the character wheel 106 is braked by the solenoid 133, plunger 120, wire 115, brake lever 112 and brake drum 108, but as shown in FIG. 7, design may also be made such that an electromagnetic brake 150 directly acts on the character wheel shaft 105. Also, the slit plate 131 and detector 132 may be replaced by a rotary encoder integral with the electromagnetic brake 130 or a rotary encoder directly connected to the pulley 128.

Figure 8:
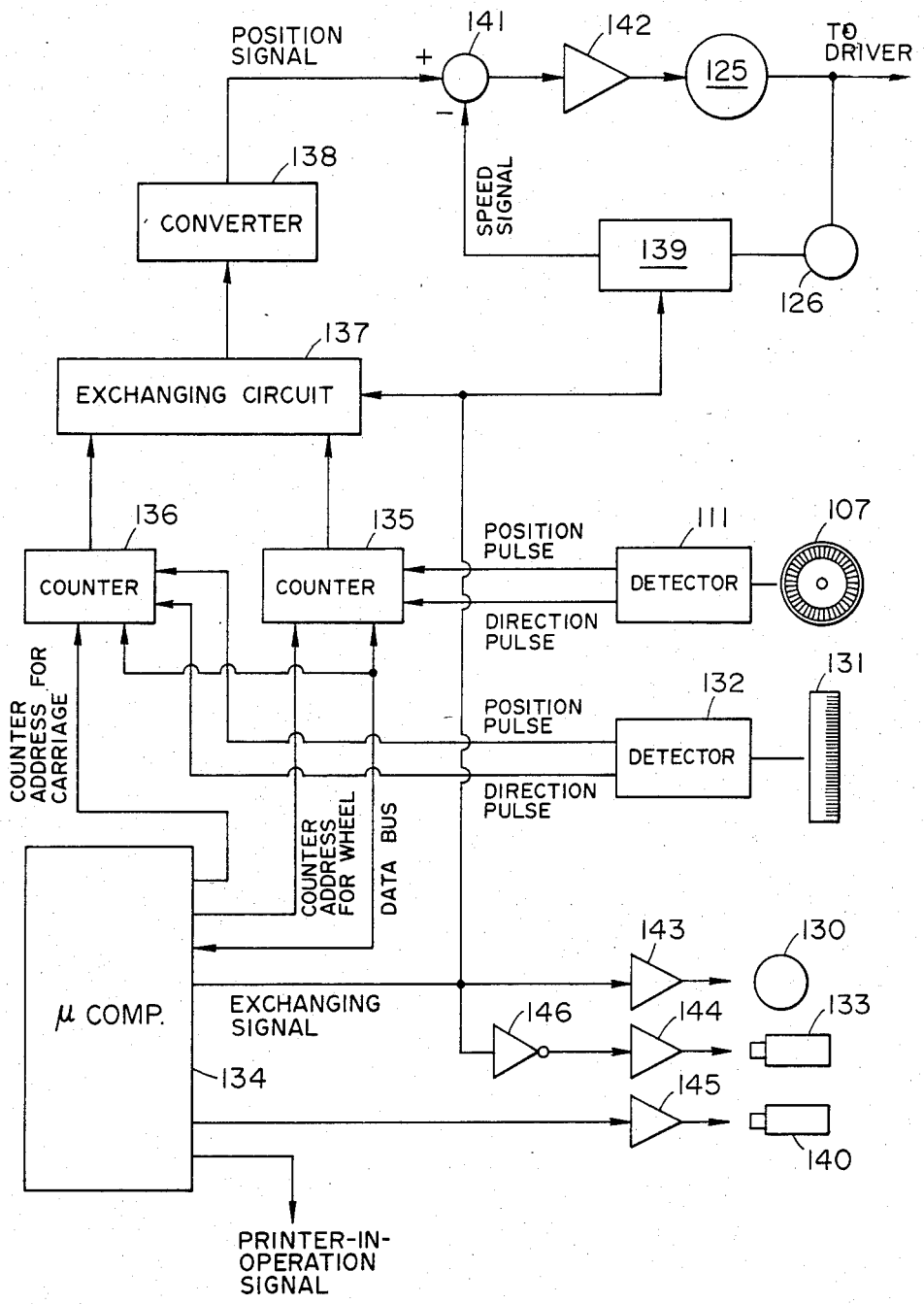
FIG. 8 is a block diagram of the electric control system.

FIG. 8 is a block diagram of the electric control system in the printer of the present invention. When a microcomputer 134 receives the print instruction from an outside keyboard, not shown, or a digital instrument, not shown, the printer-in-operation signal is rendered to a high level and the character at the current hold position is compared with the character of the print instruction to determine the amount and direction of rotation of the character wheel 106. The content of a position counter 135 for character wheel which originally should be zero is read out through a data path at the time on the left-hand side of two solid lines of a counter address for wheel indicated in FIG. 9, and said amount of rotation is corrected, and at the solid-line time on the righthand side of the counter address for wheel, the corrected value is newly set to the position counter 135 for character wheel through the data path. Immediately after this setting, the microcomputer 134 puts out a character wheel/carriage change-over signal.

This change-over signal operates the electromagnetic brake 130 to brake the carriage 103 and release the solenoid 133 for braking the character wheel. Also, this change-over signal connects the position counter 135 for character wheel to a digital-analog converting circuit 138 through a change-over circuit 137 during high level, and connects the position counter 136 for carriage to the digital-analog converting circuit 138 through the change-over circuit 137 during low level, to thereby generate a position signal.

A speed feedback amount control circuit 139 controls the speed feedback amount by the said change-over signal because the speed feedback amount providing a critical brake differs due to the difference in inertia load and friction load to the motor between the time when the motor 125 is driving the character wheel 106 and the time when the motor is driving the carriage 103.

When the solenoid 133 for braking the character wheel is released, the character wheel 106 rotates so as to render the content of the position counter 135 for the wheel to zero. As indicated by the broken line portion of the counter address for the wheel shown in FIG. 9, the content of the position counter 135 for the wheel is monitored by the microcomputer 134 and when the content of the position counter 135 becomes smaller than the set value (namely, when the character wheel rotates to the vicinity of the targe position), a hammer solenoid 140 is operated in expectation of the flight time of the printing hammer 110. Of course, the hammer solenoid 140 may be operated after the character wheel 106 has been completely stopped.

Figure 9:
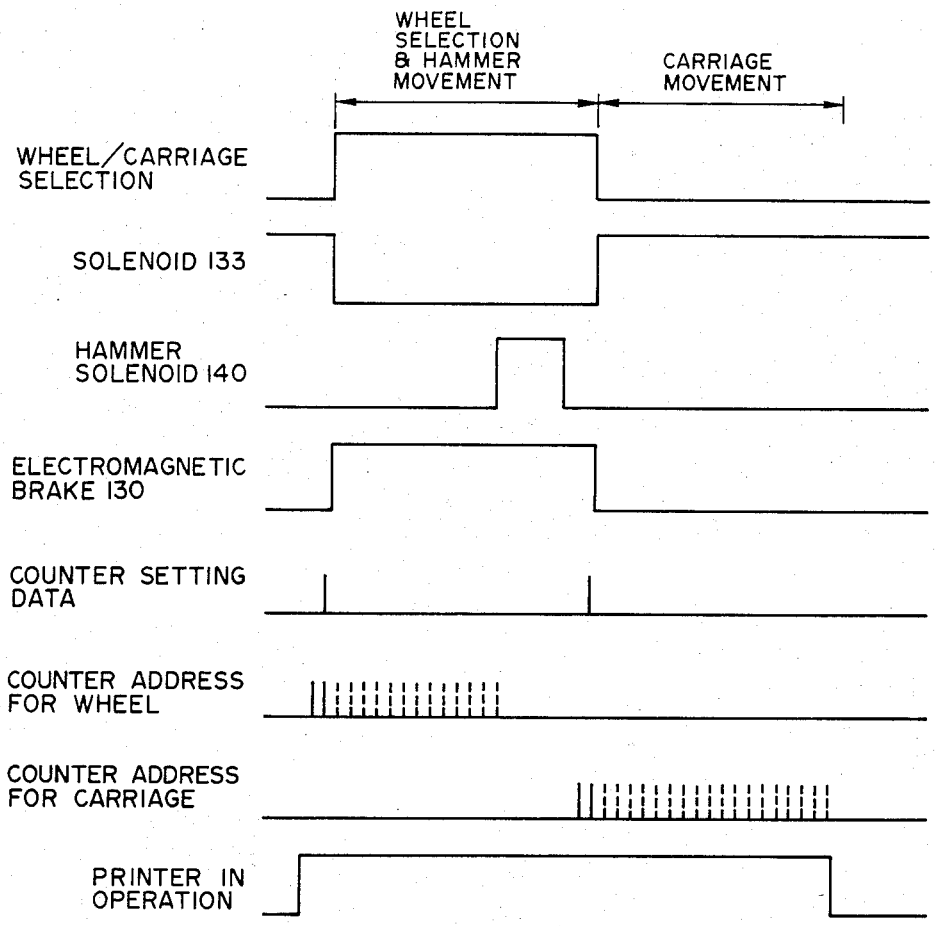
FIG. 9 illustrates the signal waveformed of the various portions of the system of FIG. 8.

After the flight time and return time of the printing hammer 110 have been taken, the amount of movement of the carriage 103 to the next print position is corrected by a value read out from the position counter 136 for the carriage at the time on the left-hand side of the two solid lines of the counter address for the carriage shown in FIG. 9, and the corrected value is set to the position counter 136 for the carriage through the data path at the solid-line time on the right-hand side of the counter address for carriage and at the same time, the character wheel/carriage change-over signal is rendered to a low level.

Therefore, the solenoid 133 is energized to brake the character wheel 106 while the electromagnetic brake 130 releases its brake. The content of the position counter 136 for the carriage becomes a position signal through the digital-analog converting circuit 138, the speed feedback amount assumes the value during the carriage drive control, and the carriage 103 moves to the next printing position. By this movement, the content of the position counter 136 comes into a stop error range, whereupon the printer-in-operation signal is rendered to a low level and thus, the printer waits for the next print instruction.

The order of the character wheel selection time and the carriage moving time may be reverse to what has been described above.

In the shown embodiments, a servomotor is used, whereas such motor may be replaced by a pulse motor. In FIG. 8, reference numeral 141 designates an adder-subtractor, reference numerals 142–145 designate amplifiers, and reference numeral 146 denotes an inverter.

As described above, the present invention is of such a construction that the character wheel and the carriage are alternately driven by a single motor and therefore, the printer of the present invention is more inexpensive than the conventional printer in which independent drive motors are provided for the character wheel and the carriage, respectively. Also, the character wheel and the carriage are alternately operated and this leads to accurate printing operation and reduced occurrence of troubles. The carriage is mage lighter in weight by the weight of a motor and can therefore be lightly reciprocated even by a small drive motor and this is very effective to enhance the printing speed.

What we claim is:

1. A printer provided with a carriage movable parallel with an axis of a platen for feeding a recording medium, comprising:

a shaft rotatably mounted on the carriage;

a character wheel fixed on said shaft;

a pulley fixed on said shaft;

first braking means for stopping rotation of said shaft at a first state thereof and allowing the rotation of said shaft at a second state thereof, said first braking means including a drum brake;

transmission means for transmitting driving power from a motor to said pulley;

second braking means for stopping movement of said carriage at a first state thereof and allowing the movement of said carriage at a second state thereof; and control means for alternately placing said first braking means and second braking means into their first states.

2. A printer according to claim 1, wherein said first braking means is provided on said carriage.

3. A printer according to claim 1, wherein said transmission means includes a wire.

4. A printer provided with a carriage movable parallel with an axis of a platen for feeding a recording medium, comprising:

a shaft rotatably mounted on the carriage;

a character wheel fixed on said shaft;

a pulley fixed on said shaft;

a motor for driving said pulley;

transmission means for transmitting driving power from said motor to said pulley;

first stopping means for stopping movement of said carriage to allow said motor to drive said character wheel; and second stopping means for stopping rotation of said shaft to allow said motor to drive said carriage, said second stopping means including brake means which is actuated by a plunger mounted on a member other than said carriage.

5. A printer according to claim 4, wherein said carriage is fixed on an endless belt, which is trained on two guide means.

6. A printer according to claim 5, wherein said first stopping means is connected to one of said guide means.

7. A printer comprising:

a motor;

a character wheel;

a carriage for supporting said character wheel thereon;

selecting means for providing a selection signal, wherein one of said character wheel and said carriage is selected for driving by said motor in accordance with the selection signal;

motor control means for controlling a driving condition of said motor by selecting one of two position signals indicative of the position of one of said character wheel and said carriage, respectively, in response to the selection signal and by providing a driving signal to said motor in accordance with the selected position signal; and a feedback circuit responsive to the output of said motor for providing a variable feedback signal to change the driving signal, said feedback circuit including means responsive to the selection signal for varying the feedback signal to change the amount of feedback.

8. A printer according to claim 7, further comprising generating means connected to said motor control means for generating the position signal indicative of the position of said character wheel.

9. A printer according to claim 8, wherein the position signal is a plurality of pulses and said motor control means includes means for counting the pulses.

10. A printer according to claim 7, further comprising generating means connected to said motor control means for generating the position signal indicative of the position of said carriage.

11. A printer according to claim 10, wherein the position is a plurality of pulses and said motor control means includes means for counting the pulses.

* * * * *